US012708227B2

(12) United States Patent
Angulo et al.

(10) Patent No.: US 12,708,227 B2
(45) **Date of Patent: *Aug. 18, 2026**

(54) CONVERTIBLE PILLOW AND TRANSFORMING METHOD THEREOF

(71) Applicant: Dozyboy, LLC, Monterey Park, CA (US)

(72) Inventors: Andrew Angulo, Monterey Park, CA (US); Sara Tsai, Monterey Park, CA (US)

(73) Assignee: Dozyboy, LLC, Monterey Park, CA (US)

( * ) Notice: Subject to any disclaimer, the term of this patent is extended or adjusted under 35 U.S.C. 154(b) by 198 days.

This patent is subject to a terminal disclaimer.

(21) Appl. No.: 18/376,145

(22) Filed: Oct. 3, 2023

(65) Prior Publication Data

US 2025/0107645 A1 Apr. 3, 2025

(51) Int. Cl.
*A47G 9/10* (2006.01)

(52) U.S. Cl.
CPC ..... *A47G 9/1045* (2013.01)

(58) Field of Classification Search
CPC ..... A47G 9/10; A47G 9/1009; A47G 9/1027; A47G 9/1036; A47G 9/1045; A47G 9/1054; A47G 9/1063; A47G 9/109; A47G 2009/1018
See application file for complete search history.

(56) References Cited

U.S. PATENT DOCUMENTS

| | | | | |
|---|---|---|---|---|
| 5,652,983 | A * | 8/1997 | Kraemer | A47G 9/0253 5/639 |
| 6,647,570 | B1 * | 11/2003 | Ong | A47G 9/1045 5/502 |
| 8,327,483 | B1 * | 12/2012 | Zamora | A47G 9/10 5/636 |
| 9,913,551 | B1 * | 3/2018 | Baker | A47G 9/10 |
| D913,724 | S * | 3/2021 | Cameron | D6/601 |
| 12,127,700 | B1 * | 10/2024 | Deschamps | A47G 9/109 |
| 2007/0174969 | A1 * | 8/2007 | Nakamura | B42D 3/10 5/636 |
| 2018/0177314 | A1 * | 6/2018 | Archibald | A47D 15/00 |
| 2019/0246819 | A1 * | 8/2019 | Lemoine | A63H 33/006 |
| 2020/0318376 | A1 * | 10/2020 | Ruggiero | A61M 21/02 |
| 2021/0153670 | A1 * | 5/2021 | Maxfield | A47G 9/10 |
| 2021/0235899 | A1 * | 8/2021 | Silva | A47G 9/0253 |

(Continued)

*Primary Examiner* — George Sun
(74) *Attorney, Agent, or Firm* — David & Raymond Patent Firm; Raymond Y Chan

(57) ABSTRACT

A convertible pillow includes a bedding pillow body and a transforming envelope. The bedding pillow body, having a first portion and a second portion, includes a pillow filler and a pillowcase containing the pillow filler therein to form a bedding pillow and having a skin contacting surface on one side and a covering surface on another side. The transforming envelope, which is integrally provided on the covering surface of the pillowcase and has an envelope opening and an envelope cavity, is shaped and sized to envelope at least a portion of the first portion and the second portion of the bedding pillow body in the envelope cavity via the envelope opening after the first portion and the second portion of the bedding pillow body are folded up on the skin contacting surface of the pillowcase to form a cushion body.

14 Claims, 8 Drawing Sheets

(56) References Cited

U.S. PATENT DOCUMENTS

| | | | | |
|---|---|---|---|---|
| 2021/0369019 | A1* | 12/2021 | Ambuske | A47G 9/1027 |
| 2023/0210281 | A1* | 7/2023 | Raines | A47C 31/11 5/482 |

* cited by examiner

CONVERTIBLE PILLOW AND TRANSFORMING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to pillow such as bedding pillow and cushion, and more particularly to a convertible pillow which is able to be converted between a bedding pillow that supports the head and neck of a user and a cushion used on couch or chair.

Description of Related Arts

Pillow is a support of the body at rest for comfort, therapy or decoration, which generally comprises a pillowcase which is a fabric envelope containing a soft stuffing, such as feathers, buckwheat hull, wool, latex, cotton, and etc. or fillers such as polyester and memory foam, therein. There are generally two types of pillow, including bedding pillow sized and shaped to support the head and neck of the user and a cushion with smaller size to be used on beds, couches or chairs for decoration or supporting various portions of the body for comfort while lying down or sitting. Typical bedding pillow has a size 16-20 in×26-30 in while a cushion has a size 16-20 in×16-20 in.

Distant travelers, especially to passengers of a red eye flight or long distant train or bus trip would like to take a sleep or nap during the transportation. However, sleeping or napping while sitting, whether on a plane, bus, train, or even at a desk, can have potential hazards for the neck and lead to discomfort and stiffness. Sleeping in an awkward position or with improper neck support can lead to neck strain causing discomfort, stiffness and pain in the neck and shoulders upon waking up. Therefore, more and more travelers as well as office workers who need to have napping at a desk carry a bedding pillow with them to support the head and neck. Using a pillow can help maintain proper alignment of the neck and spine, especially for sleeping or napping while sitting. Also, traveling across time zones can disrupt sleep patterns, leading to fatigue and let lag, so that having a familiar and comfortable pillow of the user can help travelers relax and potentially get some sleep that can ease the effects of the jet lag.

In addition, airplane, bus and train seats are used by many people, and the cleanliness of these seats is a doubtful problem to the traveler to have his or her face in contact thereon while sleeping or napping. Using a personal pillow acts as a barrier between the traveler and potentially unclean surfaces. The use of a pillow can also help block out noise and light, creating a more conducive environment for rest on planes or trains.

On the other hand, long periods of sitting on a plane or at a desk can increase the risk of blood clots and deep vein thrombosis. Using a cushion to elevate the legs slightly can help improve blood circulation and reduce the risk of their health issues.

However, the bulky size of the bedding pillow also causes inconvenience for carrying or storing to the user. The bedding pillow is designed to have a longer size to support the head and neck but not to be used as a cushion to elevate the legs and support the lower back while the cushion is specially shaped to fit the natural curve of the lower back so as to distribute the pressure of the upper body evenly across the lower back, to relax the muscles around the lumbar area more effectively, and to promote better spinal alignment while sitting. To an office worker, it is acceptable to store both a pillow and a cushion, but to a traveler, it does not make sense to carry both his or her personal pillow and cushion at the same time.

SUMMARY OF THE PRESENT INVENTION

The invention is advantageous in that it provides a convertible pillow which can be transformed from a bedding pillow to a cushion by enveloping at least a portion of a first portion of the pillow by the user, wherein the folded first portion is retained in position by a retaining arrangement of a transforming envelope built in the convertible pillow.

Another advantage of the invention is to provide a convertible pillow which can be transformed from a cushion to a bedding pillow simply by releasing the folded first portion out of the holding envelope of the convertible pillow.

Another advantage of the invention is to provide a convertible pillow which is configured to have a skin contacting surface that can be isolated and protected from contacting with outside by converting the convertible pillow into a cushion when it is not used as a bedding pillow so as to keep clean of the skin contacting surface that is arranged to be contact with the user's face when the convertible pillow is transformed into a bedding pillow.

Another advantage of the invention is to provide a method of transforming a convertible pillow from a bedding pillow to a cushion, and vice versa, by the user without any assistance of external tool.

Another advantage of the invention is to provide a convertible pillowcase for receiving a conventional bedding pillow to form a convertible pillow that can be transformed from a bedding pillow to a cushion by enveloping a first portion of the pillow by the user, wherein the folded first portion is retained in position by a retaining arrangement of a holding envelope built in the convertible pillow, and transformed from a cushion to a bedding pillow simply by releasing the folded first portion out of the holding envelope of the convertible pillow.

Another advantage of the invention is to provide a convertible pillowcase which is configured to have a skin contacting surface that can be isolated and protect from contacting with outside when it is not in used.

Additional advantages and features of the invention will become apparent from the description which follows, and may be realized by means of the instrumentalities and combinations particular point out in the appended claims.

According to the present invention, the foregoing and other objects and advantages are attained by a convertible pillow, comprising:

a bedding pillow body, having a first portion and a second portion, comprising:

a pillow filler; and a pillowcase containing the pillow filler therein to form a bedding pillow and having a skin contacting surface on one side and a covering surface on another side;

a transforming envelope, being integrally provided on the covering surface of the pillowcase and having an envelope opening and an envelope cavity shaped and sized to envelope at least a portion of the first portion of the bedding pillow body in the envelope cavity via the envelope opening after the first portion and the second portion of the bedding pillow body are folded on the skin contacting surface of the pillowcase to form a cushion body; and a retaining arrangement provided on the pillowcase and configured to retain the bedding pillow body in form of the cushion body by holding the first portion and the second portion of the bedding pillow body in a folded condition and retaining the folded first portion of the bedding pillow body being enveloped in the transforming envelope.

In one embodiment, the transforming envelope comprises an envelope panel, preferably made of the same fabric of the pillowcase, having a top side, a bottom side integrally connected with one end side of the pillowcase, and two edge sides integrally connected to two longitudinal sides of the pillowcase, wherein the envelope panel is configured to overlap on the covering surface of the pillowcase to define the envelope cavity between an inner surface of the envelope panel and the covering surface of the pillowcase and the envelope opening between the top side of the envelop panel and the covering surface of the pillowcase.

In one embodiment, a length of each of the edge sides of the envelope panel is generally equal to or slightly less than a half length of the longitudinal side of the pillowcase.

In one embodiment, the retaining arrangement includes a resilient unit provided along the top side of the envelope panel of the transforming envelope so as to provide an elastic pressure along the top side against the bedding pillow body.

In one embodiment, the resilient unit comprises two resilient elements provided at two end portions of the top side of the envelope panel respectively so as to apply resilient stress at the two end portions of the top side of the envelope panel to render a main portion between the two end portions of the top side of the envelope panel applying the elastic pressure against the bedding pillow body.

In one embodiment, the retaining arrangement includes at least a pair of first and second fastening elements respectively affixed to the end sides of the pillowcase such that when the bedding pillow body is folded up, the first fastening element and the second fastening element are able to be fastened with each other to retain the folded condition of the first portion and the second portion of the bedding pillow body, so that the bedding pillow body is retained in form of the cushion body by holding the first portion and the second portion in the folded condition and retaining the folded first and second portions of the bedding pillow body being enveloped in the transforming envelope.

In accordance with another aspect of the invention, the present invention comprises a method of transforming a convertible pillow from a bedding pillow to a cushion, which includes steps of:

enveloping at least a portion of a first portion of a bedding pillow body which is folded up with a second portion of the bedding pillow body in a transforming envelope integrally provided on a covering surface of a pillowcase of the bedding pillow body while a skin contacting surface of the pillowcase is enclosed in the transforming envelope so as to transform the bedding pillow body to a cushion body; and retaining the convertible pillow in form of the cushion body by holding the first portion and the second portion of the bedding pillow body in a folded condition and retaining the folded first portion being enveloped in the transforming envelope.

In one embodiment, the method further comprises a step of fastening a first fastening element and a second fastening element provided on two end sides of the pillowcase respectively after the first portion and the second portion of the bedding pillow body are folded up with each other so as to retain the folded condition of the first portion and the second portion of the bedding pillow body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
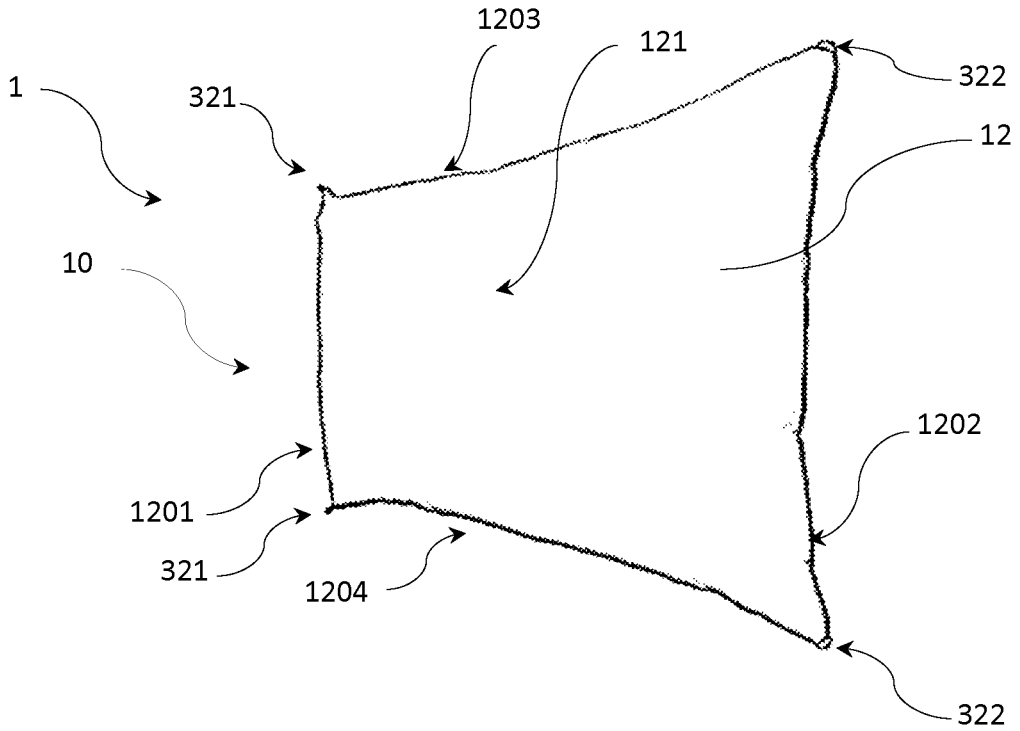
FIG. 1 is a perspective view of a convertible pillow in form of a bedding pillow body according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring FIG. 1 to FIG. 10C, a convertible pillow 1 according to a preferred embodiment of the present invention is illustrated. The convertible pillow 1 comprises a bedding pillow body 10 which has a first portion 101 and a second portion 102, a transforming envelope 20 and a retaining arrangement 30.

The bedding pillow body 10 comprises a pillow filler 11 (as shown in FIG. 7A-FIG. 7B and FIG. 10A-FIG. 10C) and a pillowcase 12. The pillowcase 12 has a covering surface 121 on one side and a skin contacting surface 122 on another side. The pillowcase 12 is a rectangular pocket, having a size approximately 16-20 in×26-30 in, made of two symmetrical fabric panels connected edges to edges to define a receiving chamber 120 between the two fabric panels, two parallel end sides 1201, 1202 and two parallel longitudinal sides 1203, 1204.

The transforming envelope 20 is integrally provided on the covering surface 122 of the pillowcase 12 and has an envelope opening 21 and an envelope cavity 22. The transforming envelope 20 is shaped and sized to envelope at least a portion of the first portion 101 of the bedding pillow body 10 in the envelope cavity 22 via the envelope opening 21 after the first portion 101 and the second portion 102 of the bedding pillow body 10 are folded up on the skin contacting surface 121 of the pillowcase 12 to form a cushion body 10' as shown in FIG. 3 and FIG. 4.

Figure 2:
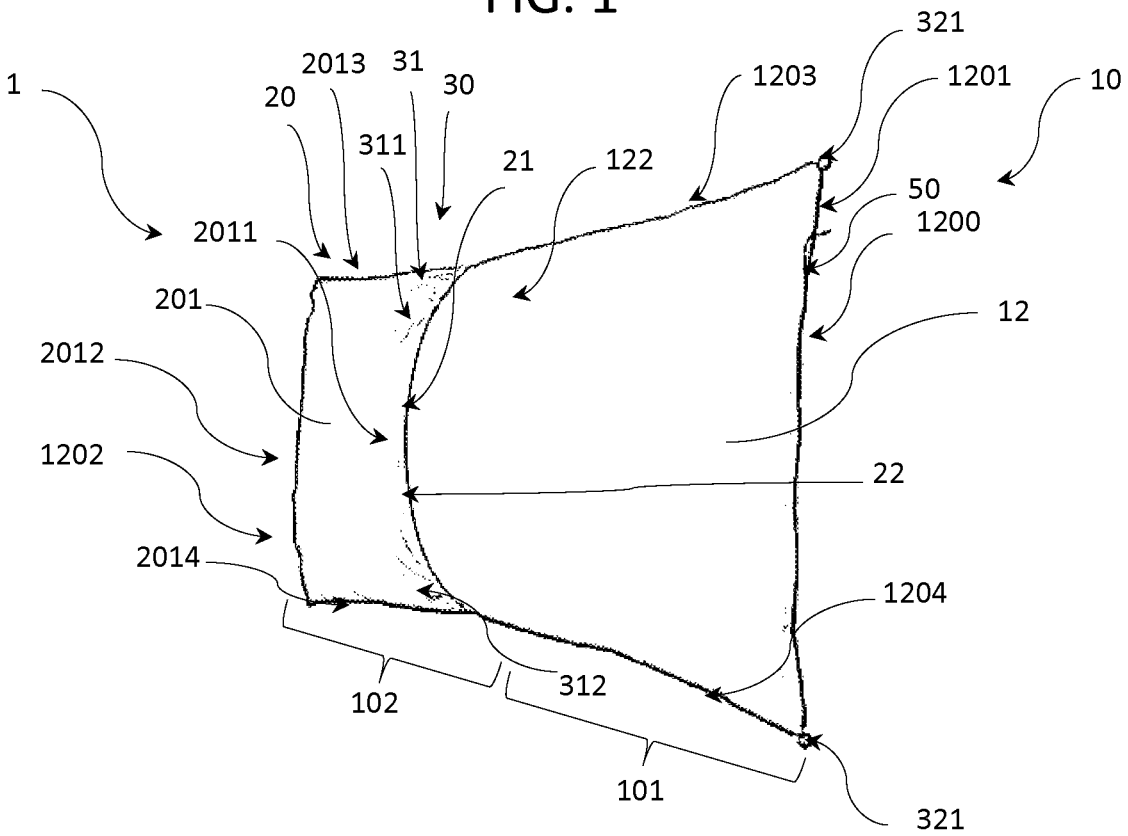
FIG. 2 is a perspective view of the convertible pillow in form of the bedding pillow body according to the above preferred embodiment of the present invention, illustrating a transforming envelope on top of a covering surface of a pillowcase of the convertible pillow.
Figure 4:
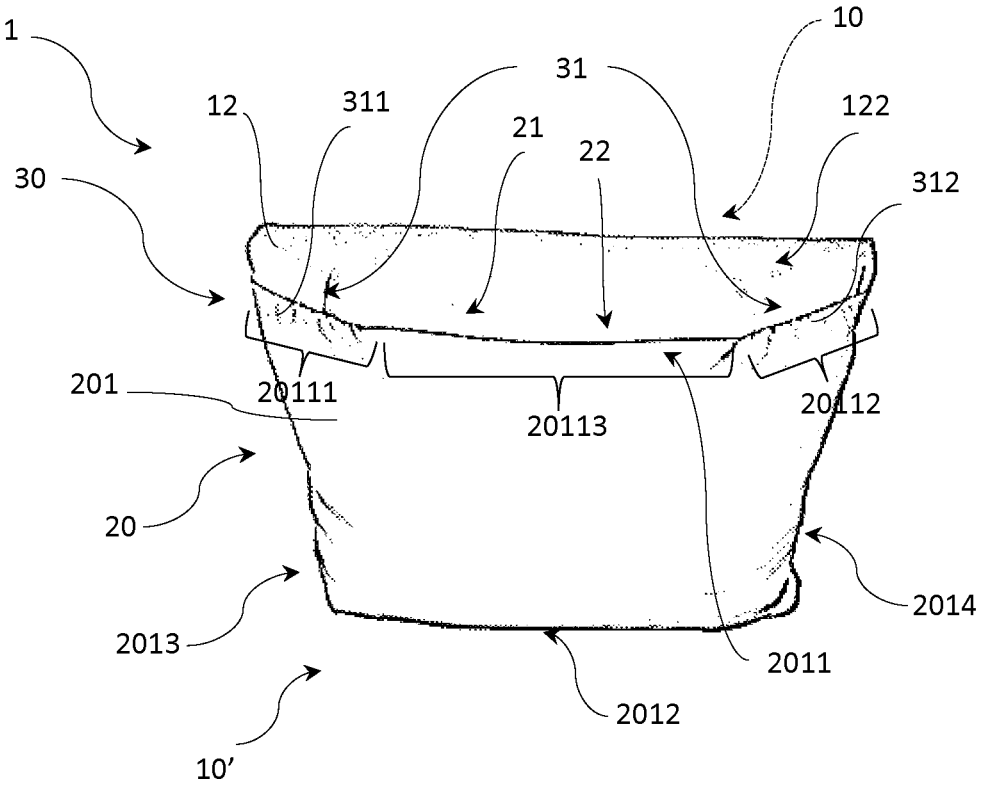
FIG. 4 is a perspective view of the convertible pillow in form of the cushion body according to the above preferred embodiment of the present invention, illustrating the transforming envelope holding the first portion of the bedding pillow body in folded condition.

According to the preferred embodiment, referring to FIG. 2 and FIG. 4, the transforming envelope 20 comprises an envelope panel 201, preferably made of the same fabric of the pillowcase 12, having a top side 2011, a bottom side 2012 integrally connected with the end side 1202 of the pillowcase 12 and two edge sides 2013, 2014 integrally connected to the two longitudinal sides 1203, 1204 of the pillowcase 12, wherein the envelope panel 20 is configured to overlap on the covering surface 122 of the pillowcase 12 to define the envelope cavity 22 between an inner surface of the envelope panel 201 and the covering surface 122 of the pillowcase 122 and the envelope opening 21 between the top side 2011 of the envelop panel 201 and the covering surface 122 of the pillowcase 12.

Figure 3:
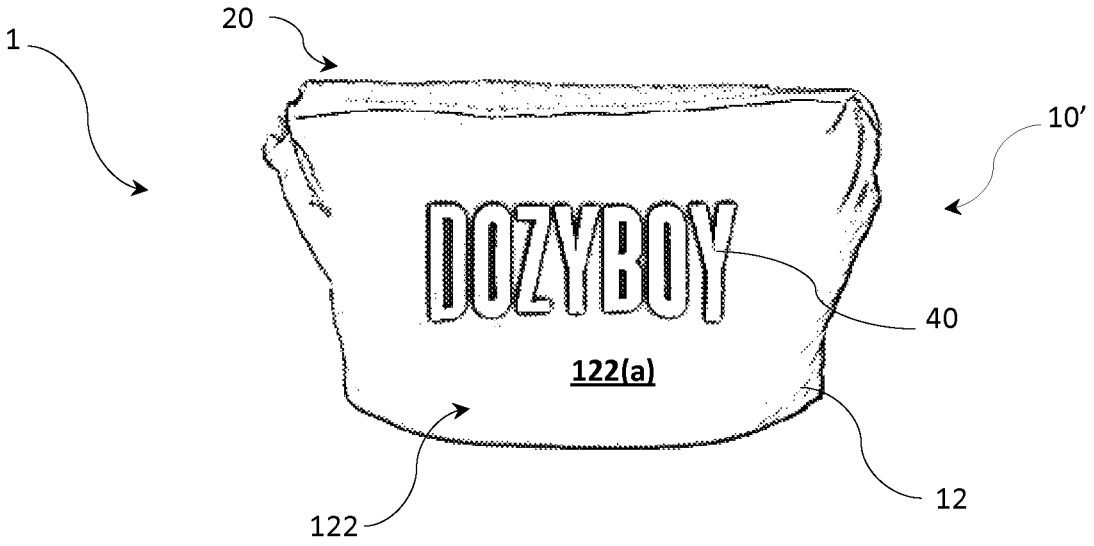
FIG. 3 is a perspective view of the convertible pillow in form of a cushion body according to the above preferred embodiment of the present invention.

The retaining arrangement 30 is provided on the pillowcase 12 and configured to retain the bedding pillow body 10 in form of the cushion body 10' (as shown in FIG. 3 and FIG. 3) by holding the first portion 101 and the second portion 102 of the bedding pillow body 10 in a folded condition and retaining the folded first portion of the bedding pillow body being enveloped in the transforming envelope 20.

The retaining arrangement 30 includes a resilient unit 31 provided along the top side 2011 of the envelope panel 201 of the transforming envelope 20 so as to provide an elastic pressure along the top side 2011 against the bedding pillow body 10.

The resilient unit 31 can be an elongated elastic band configured along the top side 2011 of the envelope panel 201. Preferably, the resilient unit 31 comprises two resilient elements 311, 312 provided at two end portions 20111, 20112 of the top side 2011 of the envelope panel 201 respectively, as shown in FIG. 2 and FIG. 4, so as to apply resilient stress at the two end portions 20111, 20112 of the top side 201 of the envelope panel 201 to render a main portion 20113 between the two end portions 20111, 20112 of the top side 2011 of the envelope panel 201 applying the elastic pressure against the bedding pillow body 10 to retain the convertible pillow 1 in form of a cushion.

Figure 8:
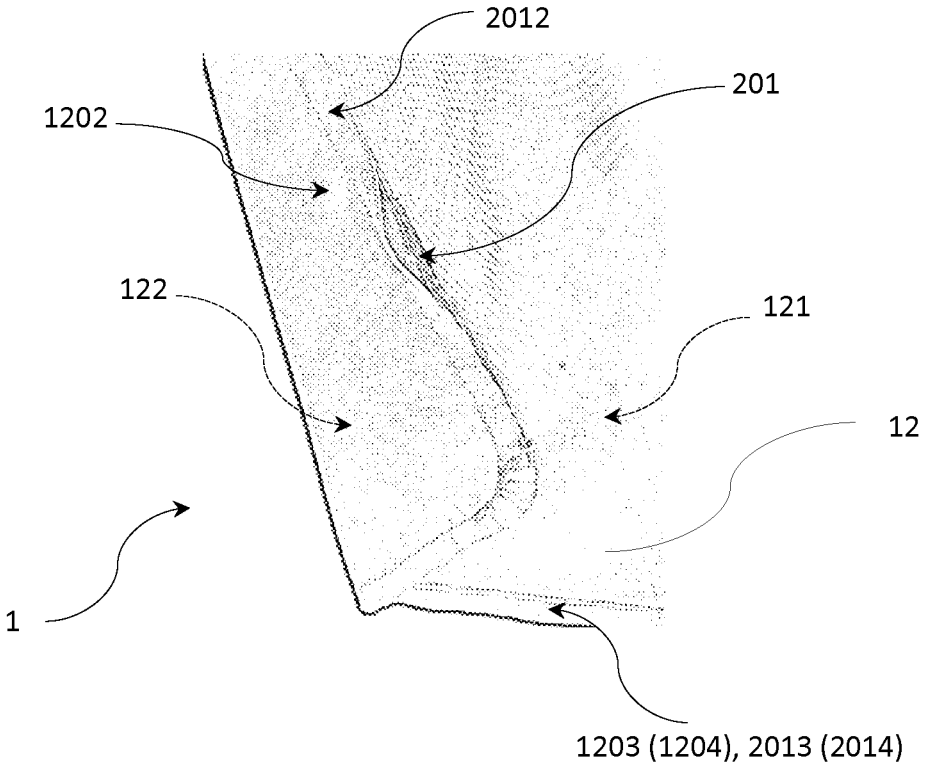
FIG. 8 is a partial schematic view illustrating the interior structure of the envelope panel and the pillowcase according to the preferred embodiment of the present invention.
Figure 9:
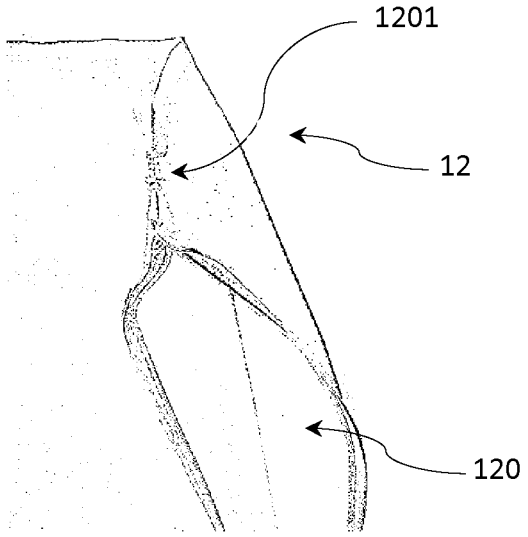
FIG. 9 is a partial schematic view illustrating the interior structure of the opening fastener of the pillowcase according to the preferred embodiment of the present invention.

In particular, a length of each of the top side 2011 and the bottom side 2012 of the envelope panel 201 is equal to a length of the end side 1202 of the pillowcase 12 and a length of each of the edge sides 2013, 2014 of the envelope panel 201 is generally equal to or slightly less than half a length of the longitudinal side 1203, 1204 of the pillowcase 12. Preferably, the bottom side 2012 of the envelope panel 201 is sewed together with the end side 1202 of pillowcase 12 integrally, as shown in FIG. 8, while the two edge sides 2013, 2014 of the envelope panel 201 are sewed with the longitudinal sides 1203, 1204 of the pillowcase 12 respectively. Preferably, the envelope panel 201 comprises two layers of fabric that facilitates the two resilient elements 311, 312 of the resilient unit 31 of the retaining arrangement 30 to be configured therebetween at the two end portions of the top side 2012 of the envelope panel 201.

It is worthing that the mounting of the envelope panel 201 on the pillowcase 12 can be embodied as other equivalent ways such as directly connecting the bottom side 2012 and the two edge sides 2013, 2014 to the pillowcase 12 by sewing, zippering and etc. The envelope panel 201 can be made of elastic material so as to perform the elastic ability inherently without the requirement of configuring the resilient unit 31. These equivalent alternatives and modifications are within the scope of the inventive concept of the present invention.

It is appreciated that the side surface where the envelope panel 201 provided thereon is defined as the covering surface 122 of the pillowcase 12 and the other side surface of the pillowcase 12 is defined as the skin contacting surface 121 that is the preferred surface for the user's face to be contacted therewith and should be maintained clean and hygienic. Accordingly, while the convertible pillow 1 of the present invention is not in use or being carried by the user, it is preferred to transform the convertible pillow 1 to the form of cushion 10' that the skin contacting surface 121 is concealed and enclosed by the transforming envelope 20.

Figure 5:
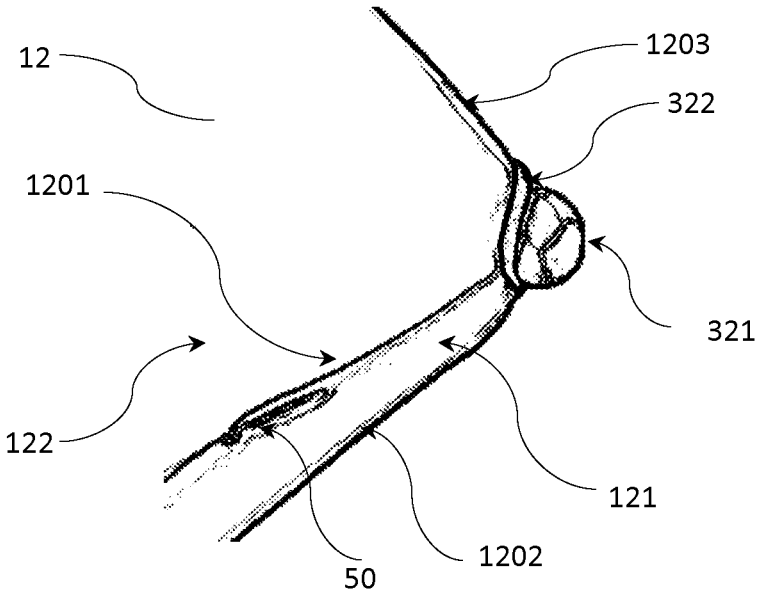
FIG. 5 is a perspective view of a fastening device of a retaining arrangement of the convertible pillow according to the above preferred embodiment of the present invention.
Figure 6A:
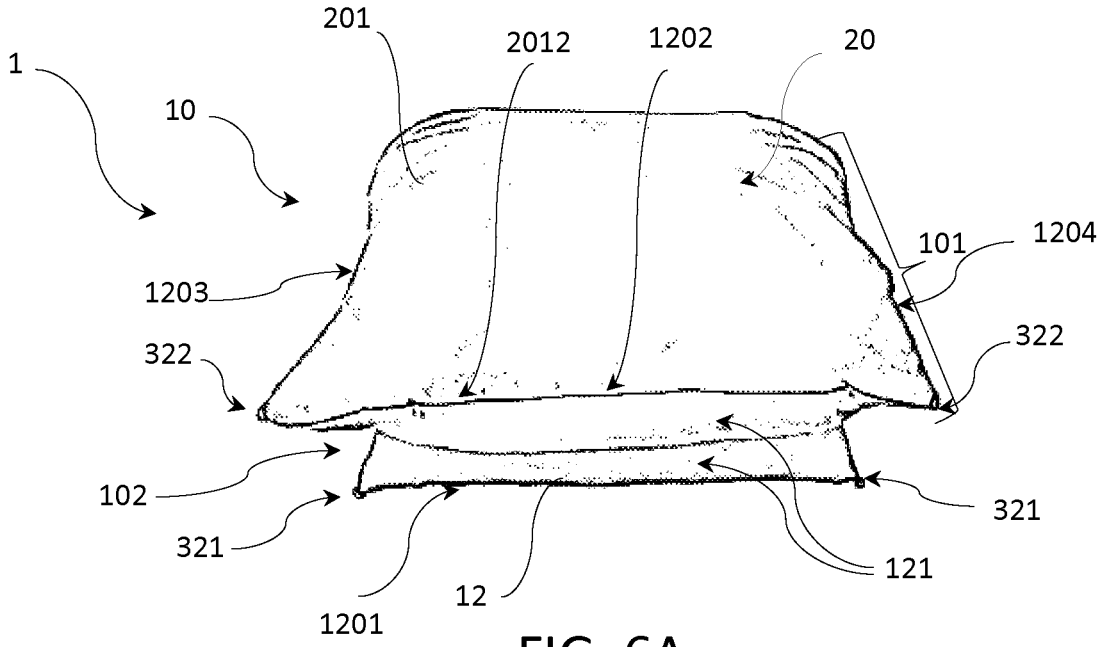
FIG. 6A to FIG. 6E are schematic views illustrating transforming steps of the bedding pillow body to form the cushion body according to the above preferred embodiment of the present invention.
Figure 6B:
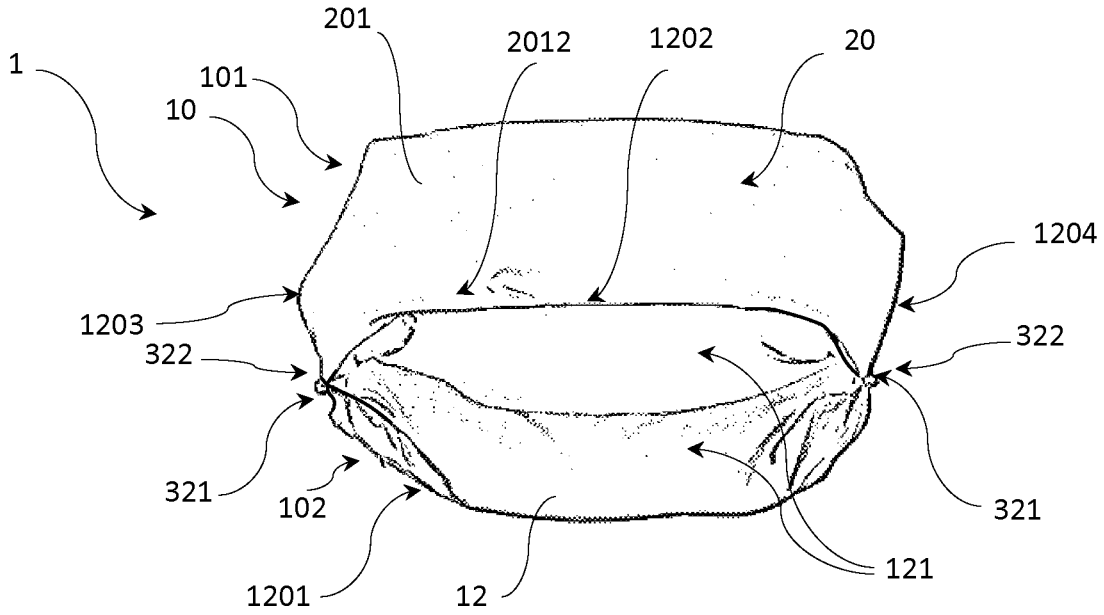

In order to further ensure the folded condition of the convertible pillow 1 such that the first portion 101 and the second portion 102 of the bedding pillow body 10 are folded up with two halves of the skin contacting surface 121 are overlapped with each other as shown in FIG. 6B, the retaining arrangement 30 further includes at least a pair of first and second fastening elements 321, 322 respectively affixed to the end sides 1201, 1202 of the pillowcase 12, as shown in FIG. 1-FIG. 2 and FIG. 5-FIG. 6B, wherein when the bedding pillow body 10 is folded up, the first fastening element 321 and the second fastening element 322 are able to be fastened with each other to retain the folded condition of the first portion 101 and the second portion 102 of the bedding pillow body 10, such that the bedding pillow body 10 is retained in form of the cushion body 10' by holding the first portion 101 and the second portion 102 in the folded condition and retaining the folded first and second portions 101, 102 of the bedding pillow body 10 being enveloped in the transforming envelope 20.

According to the preferred embodiment of the present invention, two first fastening elements 321, each being embodied as loop fastener, are connected to two corners of the end side 1201 of the pillowcase 12 and the second fastening elements 322, each being embodied as knot fastener, are connected to two corners of the end side 1202 of the pillowcase. To fasten the first fastening elements 321 with the second fastening elements 322 with each other by fastening the knot fasteners 322 by the loop fasteners 321 respectively as shown in FIG. 5, the folding up of the first portion 101 and the second portion 102 of the bedding pillow body 10 as shown in FIG. 6A is retained in the folded condition as shown in FIG. 6B. It is appreciated that other fastening elements such as hook and loop fasteners are applicable to the present invention.

Figure 10A:
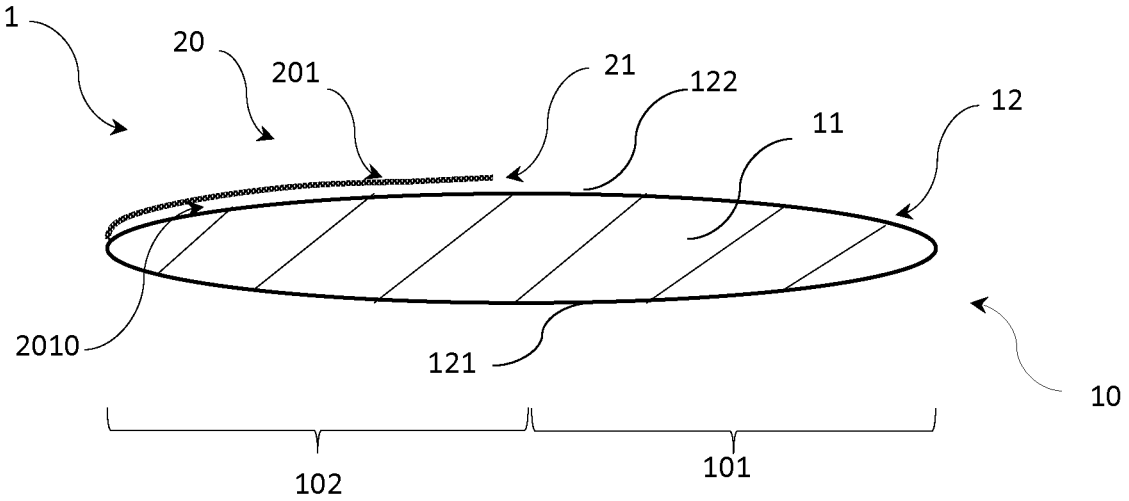
FIG. 10A to FIG. 10C are sectional schematic views illustrating steps of a transforming method of the convertible pillow according to the preferred embodiment of the present invention.
Figure 10B:
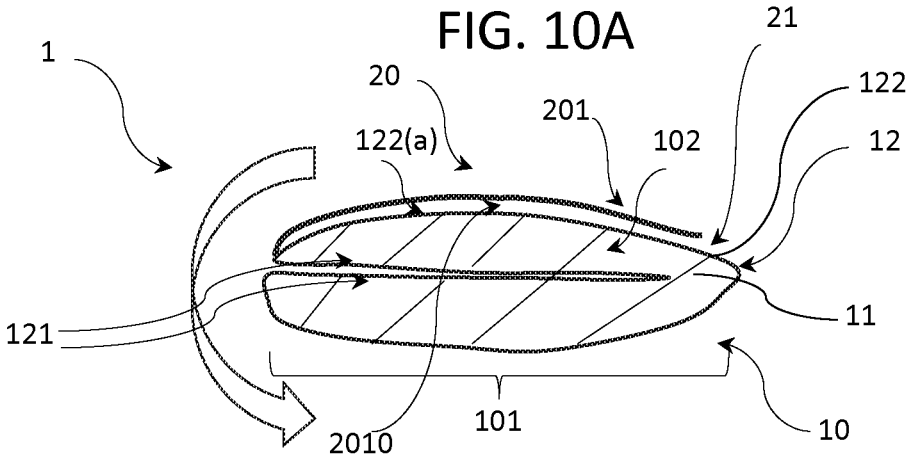

By means of the configuration of the convertible pillow 1 of the present invention, the bedding pillow body 10 can be transformed into a cushion body 10' by enveloping at least a portion of the first portion 101 of the bedding pillow body 10 through the following steps:

(a) Fold up the first portion 101 and the second portion 102 of the bedding pillow body 10, as shown in FIG. 6A and FIG. 10A-FIG. 10B.

In the preferred embodiment, the first fastener elements 321 and the second fastener elements 322 are provided for fastening with each other respectively as shown in FIG. 6B and FIG. 10B.

Figure 6C:
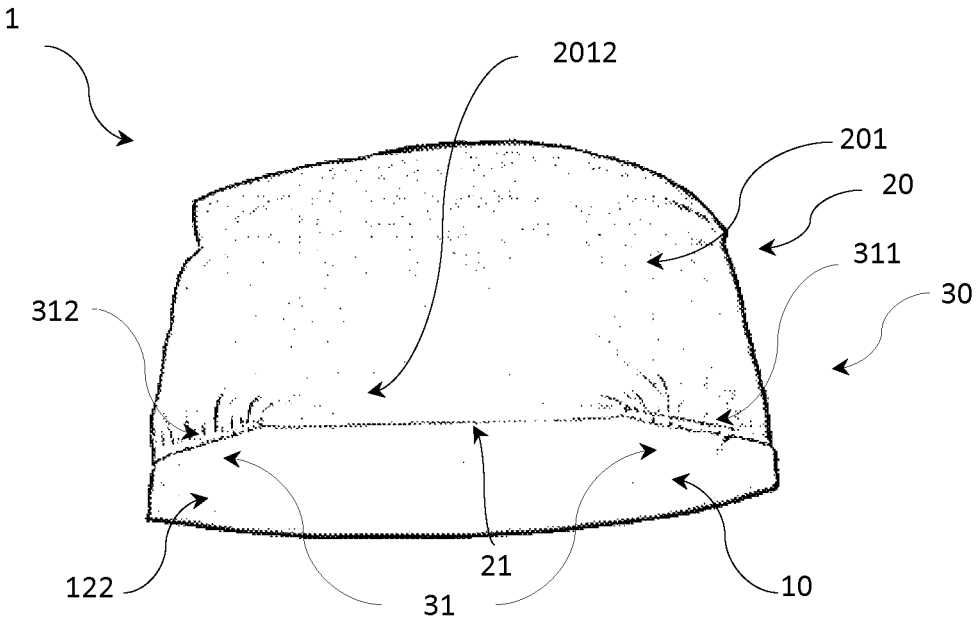

When folding up the first portion 101 and the second portion 102 of the bedding pillow body 10, the skin contacting surface 121 of the pillowcase 12 is preferred to be folded overlappedly, such that the transforming envelope 20 provided on the covering surface 121 is exposed outside as shown in FIG. 6C and FIG. 10B.

Figure 6D:
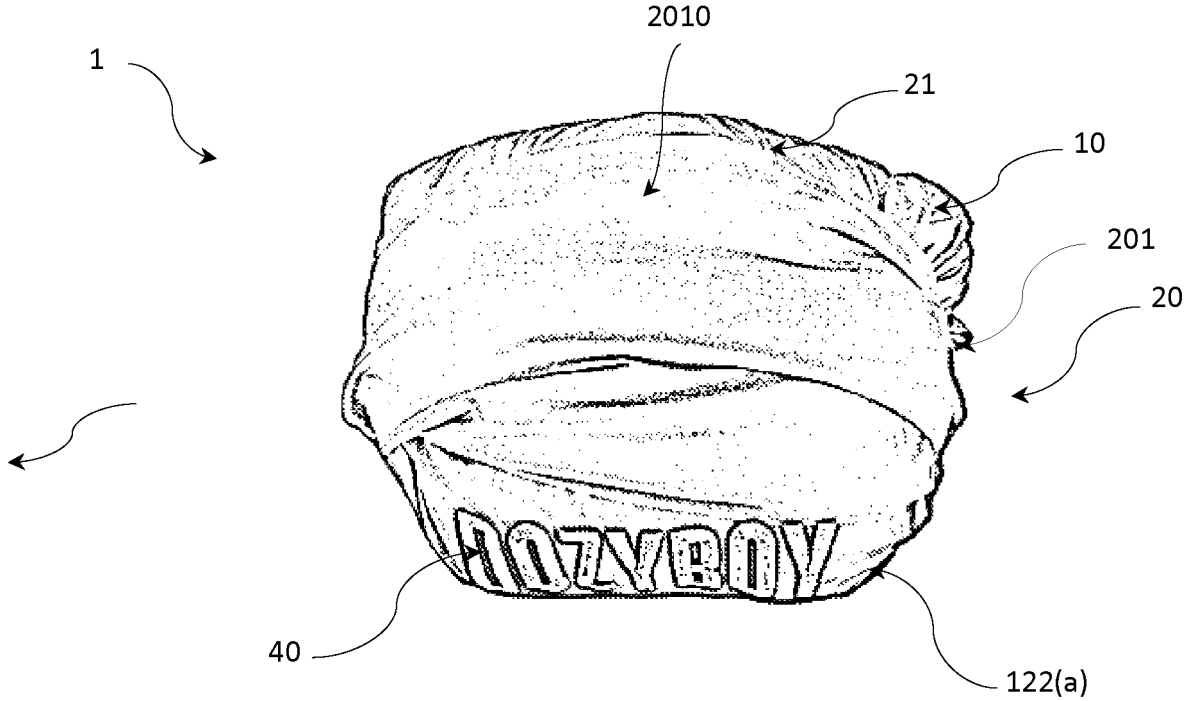
Figure 6E:
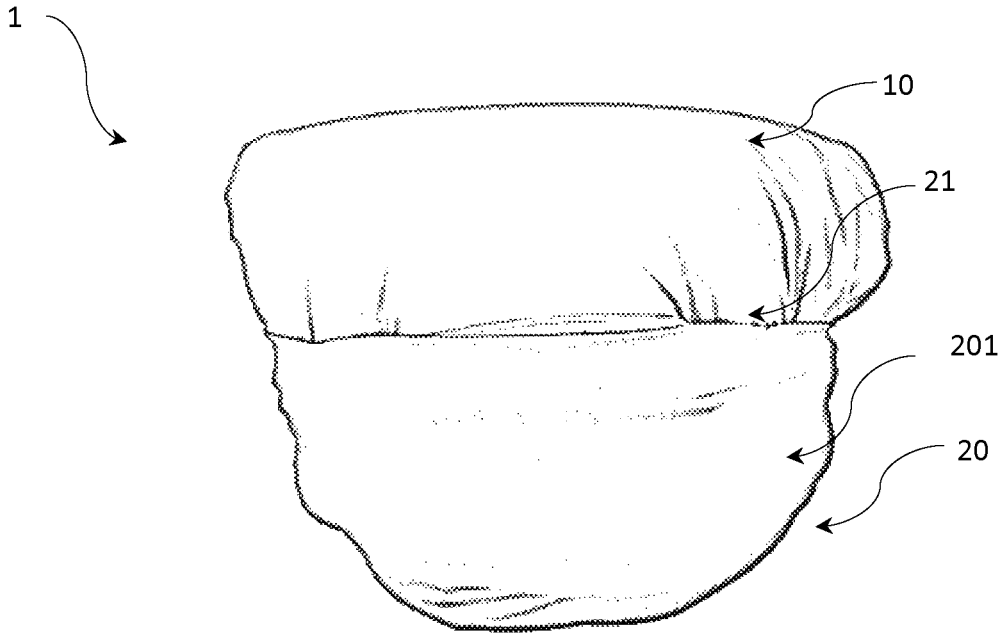
Figure 7A:
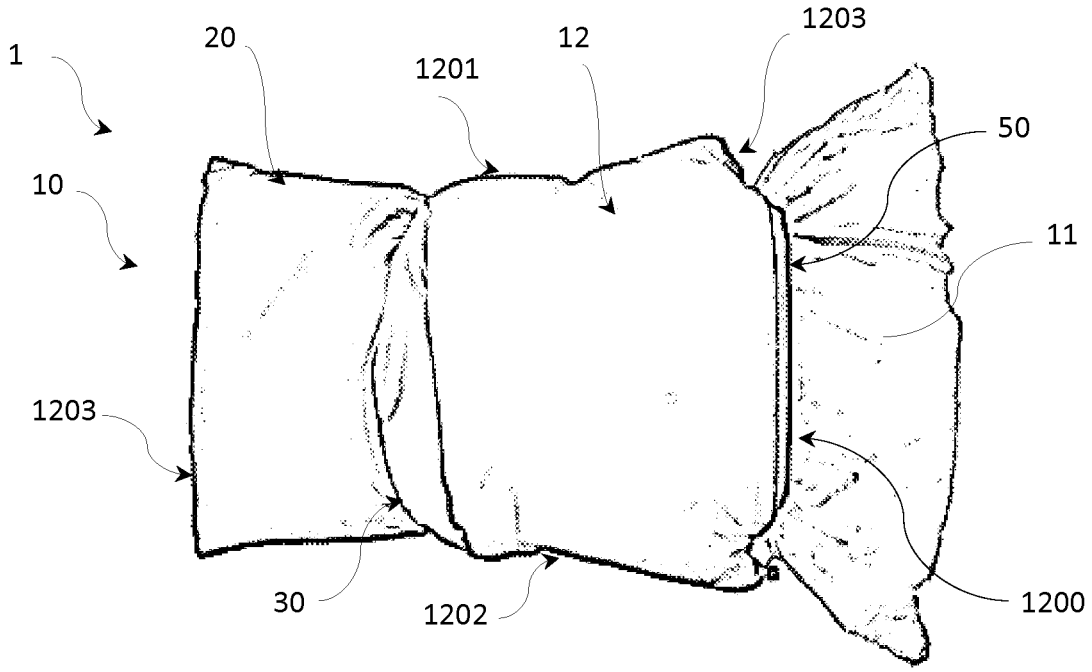
FIG. 7A to FIG. 7B are schematic views illustrating the installation of a bedding pillow in the pillowcase to form the convertible pillow according to the above preferred embodiment of the present invention.
Figure 7B:
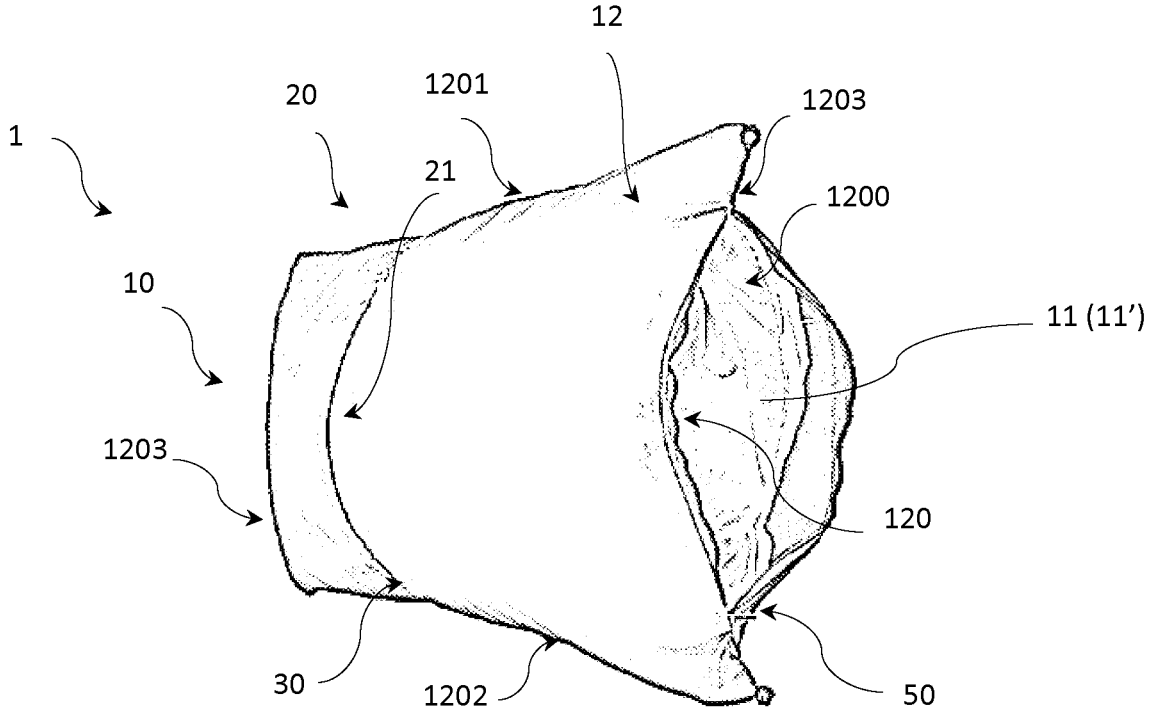
Figure 10C:
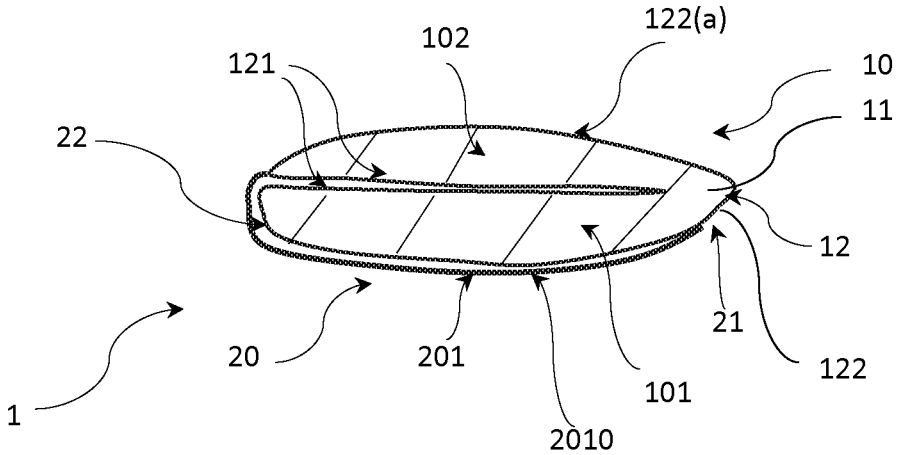

(b) Envelope at least a portion of the first portion 101 of the bedding pillow body 10 in the transforming envelope 20 through the following steps:

(b1) enlarging the envelope opening 21 by stretching the resilient elements 311, 312, as shown in FIG. 10B;

(b2) as shown in FIG. 6D and FIG. 10B-FIG. 10C, turning over an inner surface 2010 of the envelope panel 201 to outside so as to fold the envelope panel 201 from overlapping on the second portion 102 of the bedding pillow body 10 to overlapping on the first portion 101 of the bedding pillow body 10, as shown in FIG. 10B and FIG. 10C, to expose a transforming portion 122(*a*) of the covering surface 122 of the bedding pillow body 10, (the transforming portion 122(*a*) is covered by the envelope panel 201 when the convertible pillow 1 is unfolded and functioned as a bedding pillow as shown in FIG. 2 and FIG. 10A), wherein the inner surface 2010 faces outside and becomes the outer surface of the cushion body 10' as shown in FIG. 10C; and (b3) inserting the first portion 101 of the bedding pillow body 10 into the envelope cavity 22 defined between the section portion 102 of the bedding pillow body 10 and the envelope panel 201 of the transforming envelope 20, as shown FIG. 3, FIG. 4 and FIG. 10C.

(c) Retain the bedding pillow body 10 in form of the cushion body 10' by holding the first portion 101 and the second portion 102 of the bedding pillow body 10 in a folded condition, as shown in FIG. 3 and FIG. 10C, and being enveloped in the transforming envelope 20.

To transform the cushion body 10' in folded condition back to the bedding pillow body 10' in unfolded condition, the user may simply reverse the above transforming steps, i.e.:

unenveloping the first portion 101 and the second portion 102 of the bedding pillow body 10 out of the transforming envelope 20 by:

enlarging the envelope opening 21 by stretching the resilient elements 311, 312;

turning over the envelope panel 201 to unfold the envelope panel 201 from overlapping on the first portion 101 of the bedding pillow body 10 as shown in FIG. 10C to overlapping on the second portion 102 of the bedding pillow body 10 as shown in FIG. 10B, wherein the inner surface 2010 faces the transforming portion 122(*a*) of the covering surface 122 of the pillowcase 12; and unfastening the first fastener elements 321 and the second fastener elements 322 and unfolding the first portion 101 and the second portion 102 of the bedding pillow body 10 so as to convert the convertible pillow 1 back to the unfolded condition as shown FIG. 1, FIG. 2 and FIG. 10A to function as the bedding pillow.

Referring to FIG. 3 and FIG. 6D, decorative pattern or logo 40 can be provided on the transforming portion 122(*a*) of the covering surface 122 of the pillowcase 12 such that when the convertible pillow 1 is folded up and transformed to the cushion body 10' in the folded condition as shown in FIG. 3 and FIG. 10C, the decorative pattern or logo 40 is exposed outside for decorative purpose.

It is worth mentioning that when no skin contacting surface is required to conceal such as the convertible pillow 1 is simply used for decorative purpose, the user may also quickly convert the bedding pillow body 10 into the cushion body 10' by inserting the first portion 101 of the bedding pillow body 10 into the envelope cavity 22 defined between the second portion 102 of the bedding pillow body 10 and the envelope panel 21, wherein the resilient elements 311, 312 are still significantly holding and retaining the first portion 101 and the second portion 102 of the bedding pillow body 10 in the folded condition.

Referring to FIG. 2 and FIG. 7A to FIG. 9, the pillowcase 12 of the present invention is embodied to further have a pillowcase opening 1200 formed on one of the end sides 1201, 1202 communicating the receiving chamber 120 with outside, so that the pillowcase 12 can be functioned as the convertible pillow 1 by receiving a conventional pillow 11' with fitting size in the receiving chamber 120. A closing element 50, such as a zipper, is preferred to be configured at the pillowcase opening 1200 to close the pillowcase opening 1200 and enclose and concealed the pillow 11' inside the receiving chamber 120.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A convertible pillow, comprising:

a bedding pillow body, having a first portion and a second portion, comprising:

a pillow filler; and a pillowcase containing said pillow filler therein to form a bedding pillow and having a skin contacting surface on one side and a covering surface on another side;

a transforming envelope, being integrally provided on said covering surface of said pillowcase and having an envelope opening and an envelope cavity, shaped and sized to envelope at least a portion of said first portion and said second portion of said bedding pillow body in said envelope cavity via said envelope opening after said first portion and said second portion of said bedding pillow body are folded up on said skin contacting surface of said pillowcase to form a cushion body; and a retaining arrangement, provided on said pillowcase and configured to retain said bedding pillow body in form of said cushion body by holding at least a portion of said first portion of said bedding pillow body in a folded condition and retaining said folded first portion being enveloped in said transforming envelope, including:

a resilient unit provided along a top side of said envelope panel of said transforming envelope so as to provide an elastic pressure along said top side against said bedding pillow body, and at least a pair of first and second fastening elements respectively affixed to two end sides of said pillowcase such that when said bedding pillow body is folded up, said first fastening element and said second fastening element are able to be fastened with each other to retain said folded condition of said first portion and said second portion of said bedding pillow body, such that said bedding pillow body is retained in form of said cushion body by holding said first portion and said second portion in said folded condition and retaining said folded first portion of said bedding pillow body being enveloped in said transforming envelope.

2. The convertible pillow, as recited in claim 1, wherein said transforming envelope comprises an envelope panel which has a top side, a bottom side integrally connected with one end side of said pillowcase, and two edge sides integrally connected to two longitudinal sides of said pillowcase, wherein said envelope panel is configured to overlap on said covering surface of the pillowcase to define said envelope cavity between an inner surface of said envelope panel and said covering surface of said pillowcase and said envelope opening between said top side of said envelop panel and said covering surface of said pillowcase.

3. The convertible pillow, as recited in claim 1, wherein said resilient unit comprises two resilient elements provided at two end portions of said top side of said envelope panel respectively so as to apply resilient stress at said two end portions of said top side of said envelope panel to render a main portion between said two end portions of said top side of said envelope panel applying said elastic pressure against said bedding pillow body.

4. The convertible pillow, as recited in claim 2, wherein said resilient unit comprises two resilient elements provided at two end portions of said top side of said envelope panel respectively so as to apply resilient stress at said two end portions of said top side of said envelope panel to render a main portion between said two end portions of said top side of said envelope panel applying said elastic pressure against said bedding pillow body.

5. The convertible pillow, as recited in claim 1, wherein said transforming envelope comprises an envelope panel which has a top side, a bottom side integrally connected with one end side of said pillowcase, and two edge sides integrally connected to two longitudinal sides of said pillowcase, wherein said envelope panel is configured to overlap on said covering surface of the pillowcase to define said envelope cavity between an inner surface of said envelope panel and said covering surface of said pillowcase and said envelope opening between said top side of said envelop panel and said covering surface of said pillowcase.

6. The convertible pillow, as recited in claim 2, wherein said transforming envelope comprises an envelope panel which has a top side, a bottom side integrally connected with one end side of said pillowcase, and two edge sides integrally connected to two longitudinal sides of said pillowcase, wherein said envelope panel is configured to overlap on said covering surface of the pillowcase to define said envelope cavity between an inner surface of said envelope panel and said covering surface of said pillowcase and said envelope opening between said top side of said envelop panel and said covering surface of said pillowcase.

7. The convertible pillow, as recited in claim 5, wherein a length of each of said edge sides of said envelope panel is generally equal to or slightly less than a half length of said longitudinal side of said pillowcase.

8. The convertible pillow, as recited in claim 6, wherein a length of each of said edge sides of said envelope panel is generally equal to or slightly less than a half length of said longitudinal side of said pillowcase.

9. The convertible pillow, as recited in claim 1, wherein said retaining arrangement includes a resilient unit provided along a top side of said envelope panel of said transforming envelope so as to provide an elastic pressure along said top side against said bedding pillow body.

10. The convertible pillow, as recited in claim 2, wherein said retaining arrangement includes a resilient unit provided along a top side of said envelope panel of said transforming envelope so as to provide an elastic pressure along said top side against said bedding pillow body.

11. The convertible pillow, as recited in claim 9, wherein said resilient unit comprises two resilient elements provided at two end portions of said top side of said envelope panel respectively so as to apply resilient stress at said two end portions of said top side of said envelope panel to render a main portion between said two end portions of said top side of said envelope panel applying said elastic pressure against said bedding pillow body.

12. The convertible pillow, as recited in claim 10, wherein said resilient unit comprises two resilient elements provided at two end portions of said top side of said envelope panel respectively so as to apply resilient stress at said two end portions of said top side of said envelope panel to render a main portion between said two end portions of said top side of said envelope panel applying said elastic pressure against said bedding pillow body.

13. The convertible pillow, as recited in claim 1, wherein said retaining arrangement includes at least a pair of first and second fastening elements respectively affixed to two end sides of said pillowcase such that when said bedding pillow body is folded up, said first fastening element and said second fastening element are able to be fastened with each other to retain said folded condition of said first portion and said second portion of said bedding pillow body, such that said bedding pillow body is retained in form of said cushion body by holding said first portion and said second portion in said folded condition and retaining said folded first portion of said bedding pillow body being enveloped in said transforming envelope.

14. The convertible pillow, as recited in claim 2, wherein said retaining arrangement includes at least a pair of first and second fastening elements respectively affixed to two end sides of said pillowcase such that when said bedding pillow body is folded up, said first fastening element and said second fastening element are able to be fastened with each other to retain said folded condition of said first portion and said second portion of said bedding pillow body, such that said bedding pillow body is retained in form of said cushion body by holding said first portion and said second portion in said folded condition and retaining said folded first portion of said bedding pillow body being enveloped in said transforming envelope.

* * * * *